US006606468B2

(12) United States Patent
Yoshiki

(10) Patent No.: US 6,606,468 B2
(45) Date of Patent: Aug. 12, 2003

(54) TONER SCATTER PREVENTING DEVICE AND IMAGE FORMING APPARATUS USING THE SAME

(75) Inventor: Shigeru Yoshiki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/058,352

(22) Filed: Jan. 30, 2002

(65) Prior Publication Data

US 2002/0102111 A1 Aug. 1, 2002

(30) Foreign Application Priority Data

Jan. 30, 2001 (JP) ..... 2001-021849
Jun. 4, 2001 (JP) ..... 2001-168354

(51) Int. Cl.[7] ..... G03G 15/08
(52) U.S. Cl. ..... 399/93; 399/98; 399/252
(58) Field of Search ..... 399/222, 92, 93, 399/98, 252, 258; 222/DIG. 1

(56) References Cited

U.S. PATENT DOCUMENTS

| | | | | |
|---|---|---|---|---|
| 3,685,485 A | | 8/1972 | Kutsuwada et al. | 399/93 |
| 4,295,734 A | * | 10/1981 | Tsuda et al. | 399/93 X |
| 4,361,396 A | * | 11/1982 | Uchida | 399/92 |
| 4,583,112 A | | 4/1986 | Morano et al. | 399/103 |
| 4,666,282 A | | 5/1987 | Rowe | 399/93 |
| 4,692,017 A | | 9/1987 | Maczuszenko et al. | 399/253 |
| 5,255,059 A | | 10/1993 | Kai et al. | 399/265 |
| 5,416,568 A | | 5/1995 | Yoshiki et al. | 399/285 |
| 5,442,430 A | | 8/1995 | Ishii et al. | 399/344 |
| 5,455,662 A | | 10/1995 | Ichikawa et al. | 399/260 |
| 5,493,365 A | | 2/1996 | Matsui et al. | 399/1 |
| 5,500,719 A | | 3/1996 | Ichikawa et al. | 399/238 |
| 5,557,382 A | | 9/1996 | Tatsumi et al. | 399/262 |
| 5,627,631 A | | 5/1997 | Ichikawa et al. | 222/DIG. 1 |
| 5,697,018 A | * | 12/1997 | Thomas et al. | 399/93 |
| 5,765,079 A | | 6/1998 | Yoshiki et al. | 399/258 |
| 5,794,108 A | | 8/1998 | Yoshizawa et al. | 399/262 |
| 5,822,663 A | | 10/1998 | Ichikawa et al. | 399/262 |
| 5,828,935 A | | 10/1998 | Tatsumi et al. | 399/260 |
| 5,848,326 A | * | 12/1998 | Komuro et al. | 399/98 |
| 5,909,610 A | | 6/1999 | Yoshiki et al. | 399/262 |
| 5,918,090 A | | 6/1999 | Ichikawa et al. | 399/120 |
| 5,970,290 A | | 10/1999 | Yoshiki et al. | 399/261 |
| 5,995,780 A | * | 11/1999 | Wayman | 399/93 |
| 6,075,963 A | | 6/2000 | Ichikawa et al. | 399/262 |
| 6,289,195 B1 | | 9/2001 | Ichikawa et al. | 399/262 |

FOREIGN PATENT DOCUMENTS

| | | | |
|---|---|---|---|
| JP | 58-163978 | | 9/1983 |
| JP | 60-3188 | | 1/1985 |
| JP | 2527797 | Y2 | 12/1996 |
| JP | 09-073230 | * | 3/1997 |
| JP | 11-231652 | * | 8/1999 |
| JP | 2000-284523 | | 10/2000 |
| JP | 2001-92254 | | 4/2001 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

A toner scatter preventing device of the present invention is applicable to an image forming apparatus of the type developing a latent image formed on an image carrier with toner stored in a developing device. The device includes an exhausting device for discharging air present in the developing device via an exhaust passage. A toner collecting device collects the toner entrained by air discharged by the exhausting device. A toner storing device is positioned upstream of the toner collecting device in the direction of air flow for storing the toner collected by the toner collecting device without causing it to drop into the toner present in the developing device. The developer is a toner and carrier mixture in which carrier grains have a weight mean grain size of 65 $\mu$m or below.

42 Claims, 8 Drawing Sheets

TONER SCATTER PREVENTING DEVICE AND IMAGE FORMING APPARATUS USING THE SAME

BACKGROUND OF THE INVENTION

1. Field of the Invention

The present invention relates to a copier, printer, facsimile apparatus, multifunction machine or similar image forming apparatus. More particularly, the present invention relates to a device for preventing toner from flying out of a developing device and an image forming apparatus using the same.

2. Description of the Background Art

An electrophotographic image forming apparatus, for example, includes a developing device for developing a latent image formed on an image carrier with toner to thereby form a corresponding toner image. The toner image is transferred from the image carrier to a sheet or recording medium. The problem with this type of apparatus is that toner not contributed to development flies out of the developing device via an opening and deposits on, e.g., the sheet, lowering image quality. In addition, such toner smears the operator's hand in the event of maintenance.

Japanese Patent Laid-Open Publication No. 10-3220, for example, discloses a toner scatter preventing device including a filter case on which a fan and a filter are mounted. The fan sucks air out of a developing device via a hole formed in the developing device and discharges it, thereby preventing toner from flying out via the opening of the developing device. The filter collects toner entrained by the resulting air stream. The collected toner is stored in a tank.

The device taught in the above document has the following problems left unsolved. The toner collected by the filter accumulates on the filter and weakens the air stream, finally fully stopping up the filter. Further, the toner accumulated on the filter drops into the developing device in the form of large lumps and deposits on the image carrier. This makes the density of toner images irregular and thereby lowers image quality.

Particularly, when toner with a small grain size is used to meet the increasing demand for faithful reproduction of dots and tonality, the toner that is fine powder is apt to fly about in air. As a result, the air stream entraining the toner from the developing device increases the amount of toner collected by suction due to the small grain size, stopping up the filter or filling up the tank soon. Such toner therefore results in the need for frequent maintenance. It follows that maintenance cost increases although high image quality is achievable.

Technologies relating to the present invention are also disclosed in, e.g., Japanese Patent Publication No. 60-3188, Japanese Patent Laid-Open Publication Nos. 2000-284523 and 2001-92254, and Japanese Utility Model No. 2,527,797.

SUMMARY OF THE INVENTION

It is an object of the present invention to provide a toner scatter preventing device capable of preventing toner from scattering over a long period of time while insuring high image quality, and an image forming apparatus using the same.

It is another object of the present invention to provide a toner scatter preventing device capable of reducing the amount of toner to fly about and extending maintenance interval even when toner with a small grain size is used, and an image forming apparatus using the same.

A toner scatter preventing device of the present invention is applicable to an image forming apparatus of the type developing a latent image formed on an image carrier with toner stored in a developing device. The device includes an exhausting device for discharging air present in the developing device via an exhaust passage. A toner collecting device collects the toner entrained by air discharged by the exhausting device. A toner storing device is positioned upstream of the toner collecting device in the direction of air flow for storing the toner collected by the toner collecting device without causing it to drop into the toner present in the developing device. The developer is a toner and carrier mixture in which carrier grains have a weight mean grain size of 65 $\mu$m or below.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
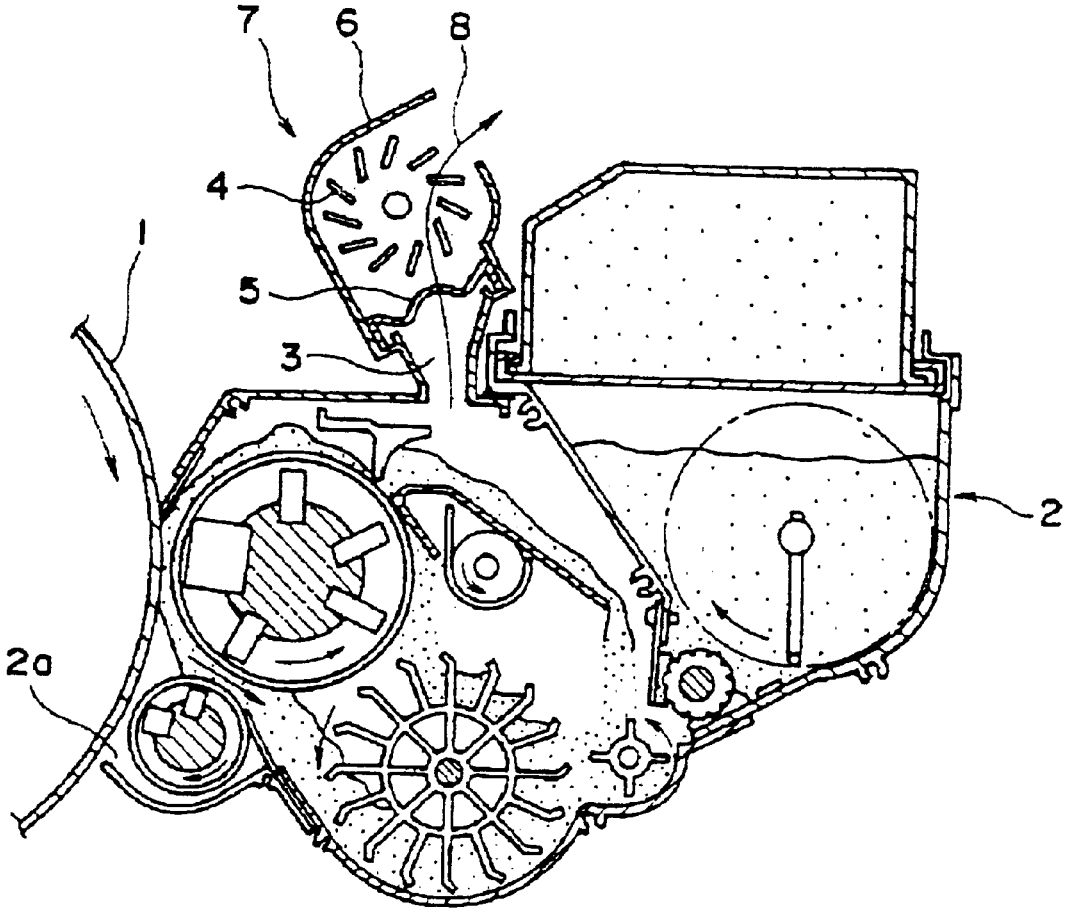
FIG. 1 PRIOR ART
FIG. 1 is a view showing a conventional toner scatter preventing device included in a developing device.

To better understand the present invention, brief reference will be made to a conventional toner scatter preventing device, shown in FIG. 1. The device to be described is taught in Laid-Open Publication No. 10-3220 mentioned earlier. As shown, the device, generally 7, is arranged in an image forming apparatus and includes a suction hole 3 and a filter case 6 on which a fan 4 and a filter 5 are mounted. The suction hole 3 is formed in a developing device 2 that adjoins an image carrier implemented as a photoconductive drum 1. The developing device 2 is formed with an opening 2*a* facing the drum 1.

In operation, the fan 4 is driven to suck air out of the developing device 2 and discharge it via the suction hole 3 and an exhaust path 8. The resulting stream of air entering the developing device 2 via the opening 2*a* prevents toner from scattering via the opening 2*a*. The filter 5 collects toner being entrained by the stream of air.

The conventional device with the configuration shown in FIG. 1 has some problems left unsolved, as stated earlier.

Figure 2:
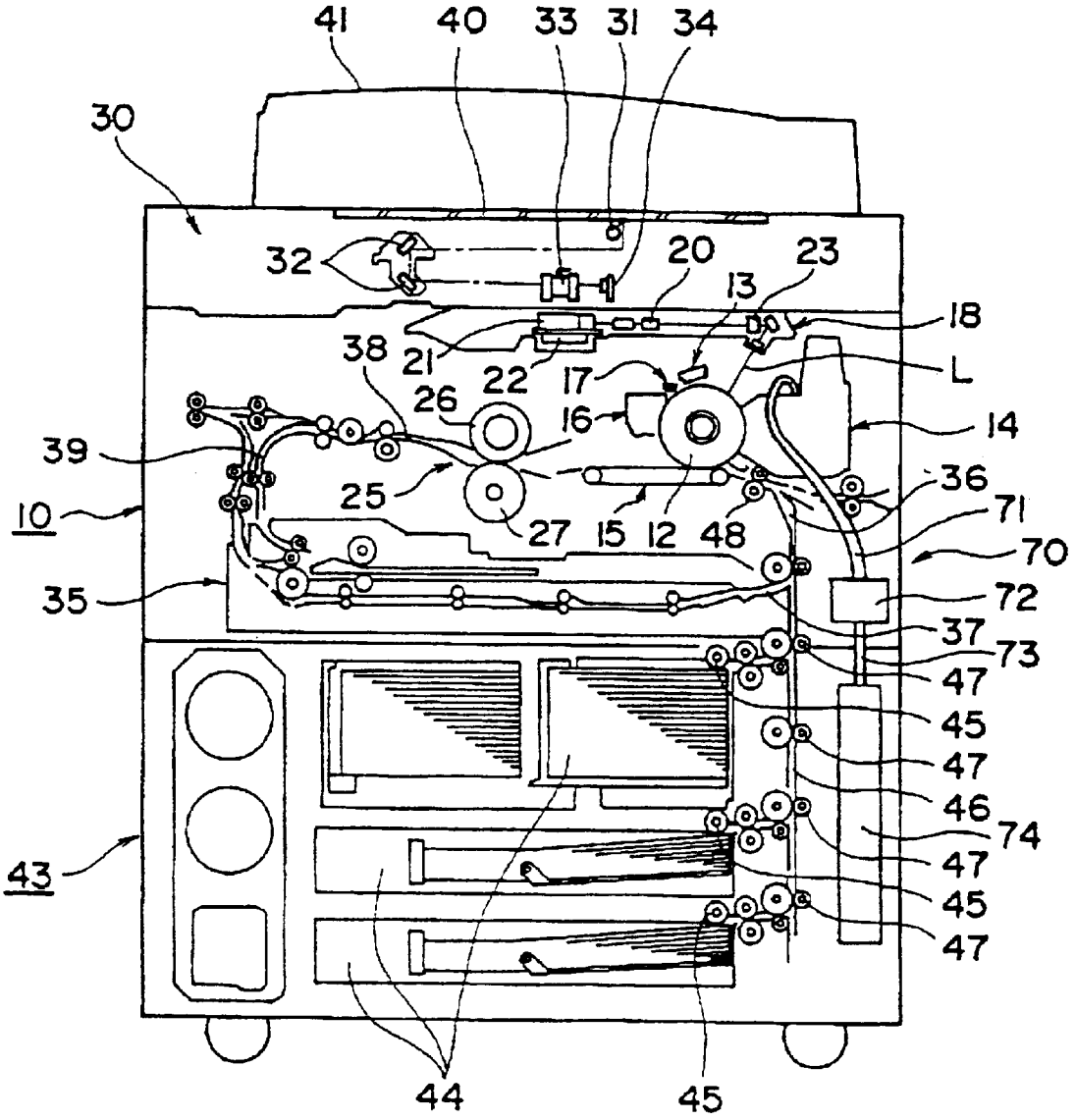
FIG. 2 is a view showing an image forming apparatus with a toner scatter preventing device embodying the present invention.
Figure 3:
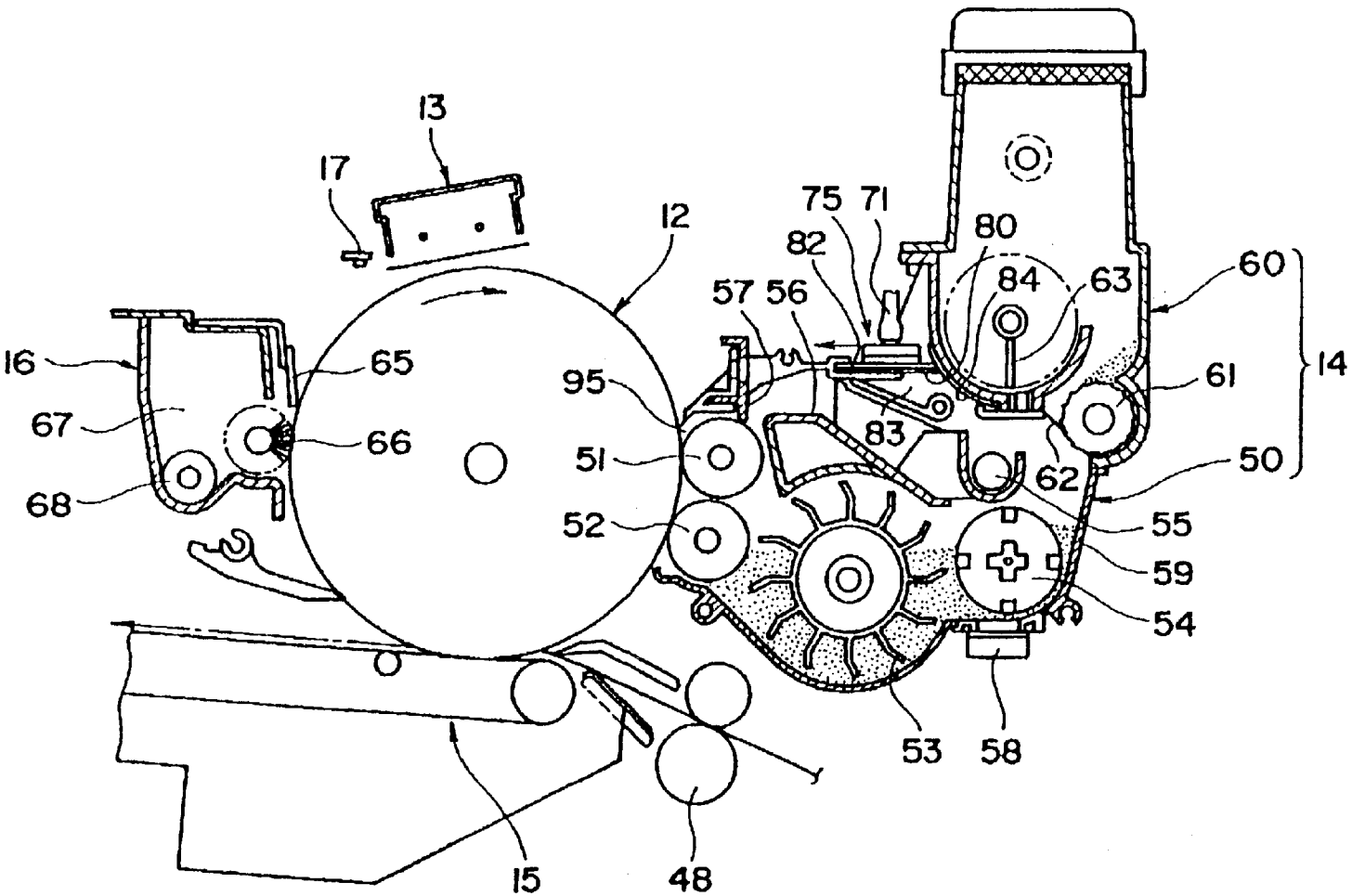
FIG. 3 is a fragmentary view of the illustrative embodiment.

Referring to FIGS. 2 and 3, a toner scatter preventing device embodying the present invention will be described. The illustrative embodiment is applied to a laser copier that is a specific form of an image forming apparatus. As shown, the laser copier includes a copier body 10 accommodating a photoconductive drum or image carrier 12. Arranged around the drum 12 are a charger 13, a developing device 14, an image transferring and sheet conveying device 15, a cleaning device 16, and a discharger 17. A laser writing unit 18 is positioned in the upper portion of the copier body 10. The laser writing unit 18 includes a laser diode or similar light source 20, a polygonal mirror 21, a motor 22 for driving the polygonal mirror 22, and optics 23 including an f/θ lens.

A fixing device 25 is positioned at the left-hand-side of the cleaning device 16, as viewed in FIG. 2. The fixing device 25 includes a heat roller 26 accommodating a heater therein and a press roller 27 pressed against the heat roller 26. A scanner or document reading device 30 is arranged above the laser writing unit 18 and includes a light source 31, a plurality of mirrors 32, a lens 33, and a CCD (Charge Coupled Device) array or similar image sensor 34.

A duplex copy unit 35 is positioned in the lower portion of the copier body 10. A refeed path 37 extends from the duplex copy unit 35 to a position beneath the drum 12. A sheet discharge path 38 extends from the outlet of the fixing device 25 while a reversal path 39 branches off the sheet discharge path 38.

An ADF (Automatic Document Feeder) 41 is mounted on the top of the copier body 10 in such a manner as to cover a glass platen 40. The ADF 41 is openable away from the glass platen 40.

The copier body 10 is mounted on a sheet bank 43 in which a plurality of sheet cassettes 44 are arranged one above the other. A pickup roller 45 is associated with each of the sheet cassettes 44 for sequentially paying out sheets one by one. The sheet paid out from any one of the sheet cassettes 44 is fed to a path 46 merging into a feed path 36. A plurality of roller pairs 47 are positioned on the path 46 for conveying the sheet.

To produce copies with the laser copier, the operator stacks desired documents on the ADF 41 or lays a desired document on the glass platen 40 by opening the ADF 41. The operator then presses a start button not shown. In response, the scanner 30 reads the document fed from the ADF 41 or the document laid on the glass platen 40 on a pixel basis. At the same time, the pickup roller 45 associated with desired one of the sheet cassettes 44 pays out one sheet to the path 46 at a time. The roller pairs 47 convey the sheet into the feed path 36. A registration roller pair 48 once stops the movement of the sheet and then drives it toward the drum 12 in synchronism with the rotation of the drum 12.

When the start switch is pressed, the drum 12 starts rotating clockwise, as viewed in FIG. 2. The charger 13 uniformly charges the surface of the drum 12 in rotation. The laser writing unit 18 scans the charged surface of the drum 12 with a laser beam L in accordance with image data output from the scanner 30, thereby forming a latent image on the drum 12. The developing device 14 develops the latent image with toner to thereby produce a corresponding toner image.

The image transferring and sheet conveying device 15 transfers the toner image from the drum 12 to the sheet conveyed to the position below the drum 12. The cleaning device 16 removes the toner left on the drum 12 after the image transfer. Further, the discharger 17 discharges the cleaned surface of the drum 12 to thereby prepare it for the next image forming cycle.

The image transferring and sheet conveying device conveys the sheet carrying the toner image to the fixing device 25. In the fixing device 25, the heat roller 26 and press roller 27 fix the toner image on the sheet with heat and pressure. The sheet with the fixed toner image is driven out of the copier body 10 to, e.g., a tray mounted on the copier body 10.

In a duplex copy mode for forming images on both sides of a sheet, the sheet carrying the toner image on one side thereof is introduced into the duplex copy unit 35 via the reversal path 39. The duplex copy unit 35 reverses the sheet and again delivers it to the position below the drum 12. At this position, another toner image is transferred from the drum 12 to the other side of the sheet, completing a duplex copy.

As shown in FIG. 3, the developing device is generally made up of a tank 50 storing a developer and a hopper 60 storing fresh toner. In the illustrative embodiment, the developer is a two-ingredient type developer, i.e., a toner and carrier mixture. The tank 50 includes a casing 59 accommodating a first developing roller 51, a second developing roller 52, a paddle wheel 53, an agitator 54 implemented as a roller, a screw 55, a separator 56, a doctor blade 57, and a toner content sensor 58. The casing 59 stores the developer. The first and second developing rollers 51 and 52 each are made up of a sleeve and a magnet roller disposed in the sleeve.

The hopper 60 accommodates a gear-like toner replenishing member 61, a regulating plate 62, and an agitator 63.

In operation, the agitator 54 in the casing 59 is rotated to agitate the developer so as to charge it by friction. The paddle wheel 53 in rotation sends the developer upward. As a result, the developer deposits on the sleeves of the first and second developing roller 51 and 52 due to the magnet rollers accommodated in the sleeves. The sleeves in rotation convey the developer while a doctor blade 57 removes excessive part of the developer. Subsequently, the toner contained in the developer deposits on the drum 12 due to a bias for development, developing a latent image formed on the drum 12.

As the developing device 14 consumes toner due to repeated image formation, the toner content of the developer decreases. The toner content sensor 58 mounted on the casing 59 senses the toner content of the developer. When the toner content decreases below a target toner content, the agitator 63 in the hopper 60 is rotated to agitate the toner while conveying it to the toner replenishing member 61. The toner replenishing member 61 is rotated to cause the regulating plate 62 to oscillate with the result that the toner is replenished to the tank 50. In this manner, the toner content of the developer is maintained substantially constant. The target toner content is determined on the basis of the output of a photosensor, not shown, measured a particular toner pattern (P pattern), which is formed on the drum 12.

No images are, in many cases, present at opposite side edge portions of a sheet. In light of this, the hopper 60 replenishes the toner over a particular range b (see FIG. 5) other than the side edge portions, so that much toner does not exist at the side edge portions.

While the toner deposited on the drum 12 is electrostatically transferred to a sheet, about 10% of the toner is left on the drum 12 after image transfer. The cleaning device 16 scrapes off such residual toner left on the drum 12 with a blade 65 and a brush roller 66. The toner removed by the blade 65 and brush roller 66 is collected in a tank 67 and then conveyed to one side of the cleaning device 16 by a screw 68. The toner is then delivered to a toner recycling device, not shown, via an opening, not shown, formed in the cleaning device 16.

As shown in FIG. 2, the laser copier further includes a device 70 for preventing the toner from scattering. The device 70 includes exhausting means 72 disposed in the copier body 10 and communicated to the developing device 14 by a suction tube 71. Toner storing means 74 is disposed in the sheet bank 43 and communicated to the exhausting means 72 by an exhaust tube 73.

Figure 4:
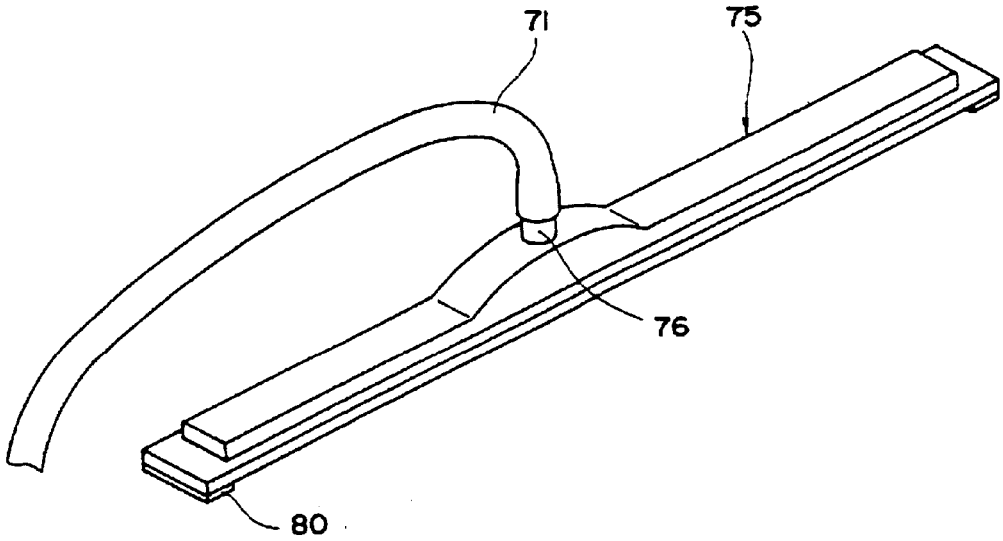
FIG. 4 is an isometric view showing a suction duct included in the illustrative embodiment.
Figure 5:
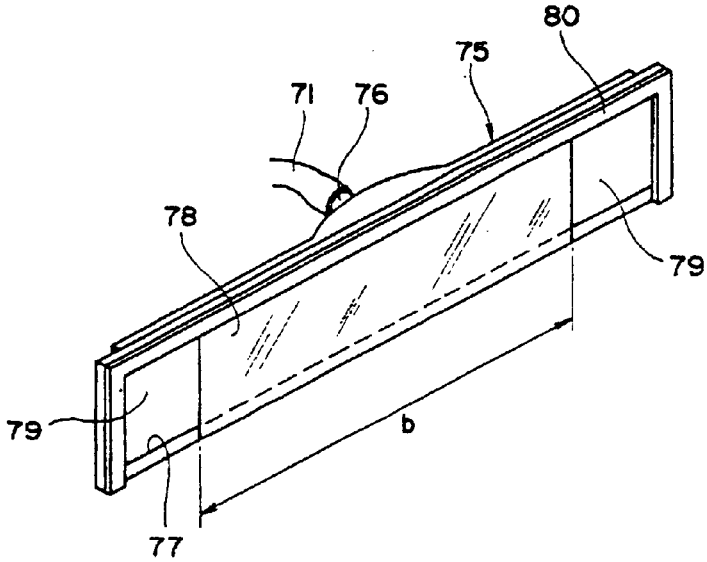
FIG. 5 is an isometric bottom view of the suction duct.

As shown in FIG. 4, an elongate suction duct 75 is affixed to the end of the suction tube 71 connected to the developing device 14. The end of the suction tube 71 is fitted in a hole 76 formed in the suction duct 75. As shown in FIG. 5, the suction duct 75 has a wide opening 77 at its bottom. A Mylar sheet or similar sheet 78 is adhered to part of the bottom of the suction duct 75 corresponding to the previously mentioned range b of the hopper 60. The sheet 78 covers only the above part of the suction duct 75, forming suction ports 79 at both sides of the duct 75. A seal member 80 is adhered to the edges of the opening 77 except for the edge adjoining the hopper 60.

As shown in FIG. 3, the casing 59 is formed with guide channels 82 at both sides thereof and an opening 83. The suction duct 75 is mounted to the opening 83 with opposite ends thereof inserted into the guide channels 82 in a direction indicated by an arrow. Subsequently, the hopper 60 is mounted to the tank 50 to thereby prevent the suction duct 75 from slipping out. A seal member 84 is adhered to the hopper 60 in order to seal it from the suction duct 75. In this configuration, the opening 83 of the casing 59 is fully closed.

Figure 6:
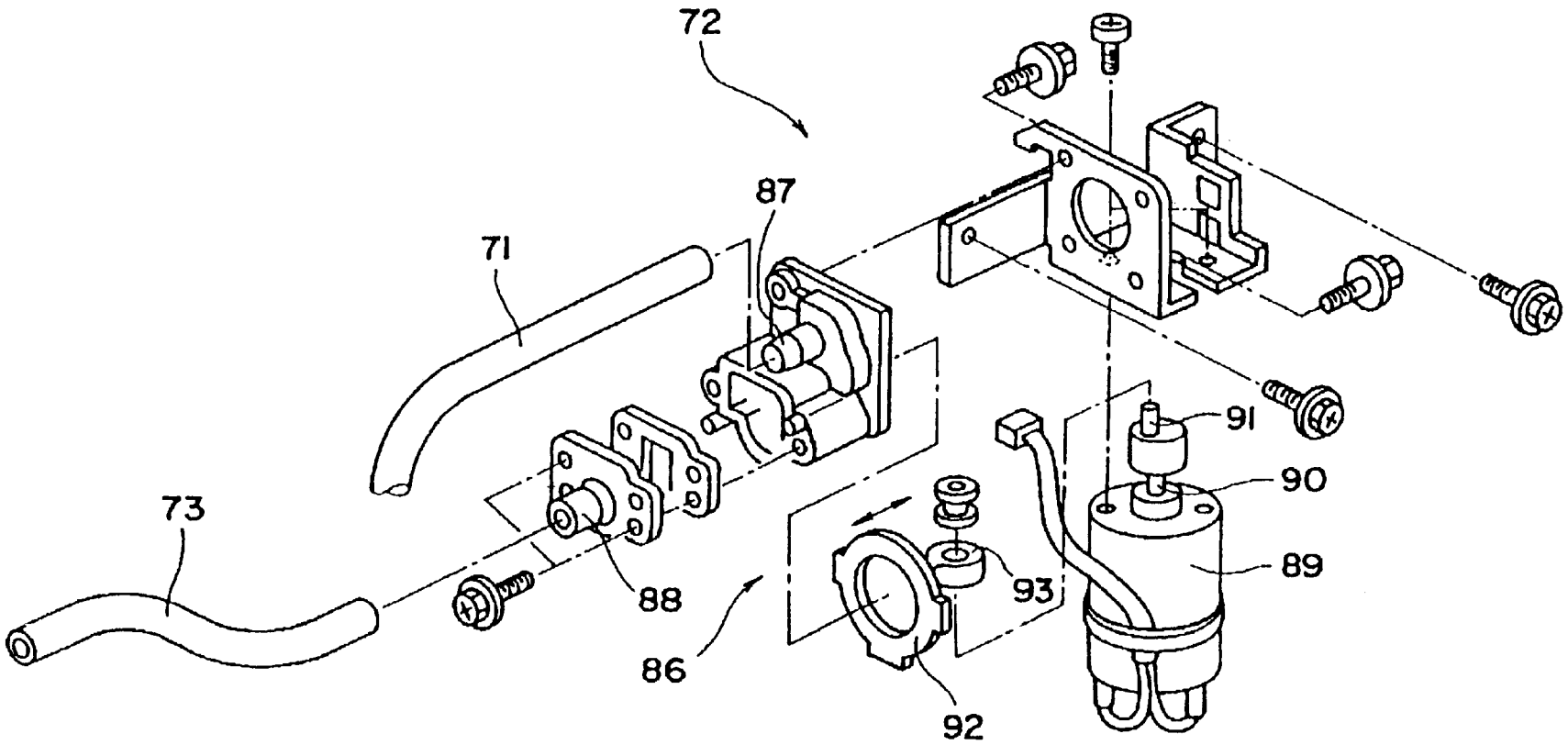
FIG. 6 is an exploded isometric view showing exhausting means included in the illustrative embodiment.

As shown in FIG. 6, the exhausting means 72 includes a pump 86 having a suction port 87 and an exhaust port 88. The other end of the suction tube 71 is connected to the suction port 87 while the other end of the exhaust tube 73 is connected to the exhaust port 88. An eccentric pin 91 is studded on a drive shaft 90 included in the motor 89. The eccentric pin 91 is fitted in part 93 of a rubber member 92.

The motor 89 is driven in synchronism with a motor for development not shown. The center of the rubber member 92 moves back and forth in a direction indicated by a double-headed arrow in FIG. 6. When a suction valve, not shown, is opened and an exhaust valve, not shown, is closed, air inside the developing device 14 is sucked via the suction ports 79 of the suction duct 75 and delivered to the pump 86 via the suction tube 71 and suction port 87. When the suction valve is closed and the exhaust value is opened, air inside the pump 86 is delivered to the toner storing means 74 via the exhaust tube 73.

Figure 7:
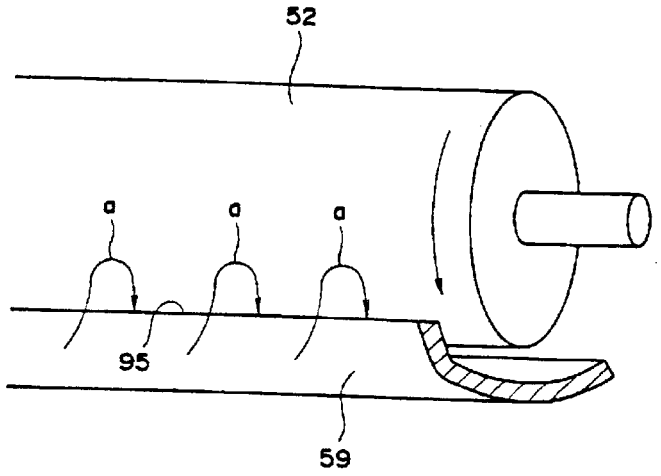
FIG. 7 is a fragmentary isometric view showing part of the illustrative embodiment.

As stated above, when the developing device 14 is in operation, the exhausting means 72 is constantly driven to such air from the developing device 14 into the device 70. At the same time, air flows through an opening 95 formed in the casing 59, FIG. 3. As a result, as indicated by arrows a in FIG. 7 specifically, air around the casing 59 is sucked into the casing 59, preventing the toner from flying out of the developing device 14. Although the developing rollers 51 and 52 in rotation may produce an air stream by sucking air via the opening 95 alone, the device 70 sucks more air to thereby more surely prevent the toner from flying about.

Figure 8:
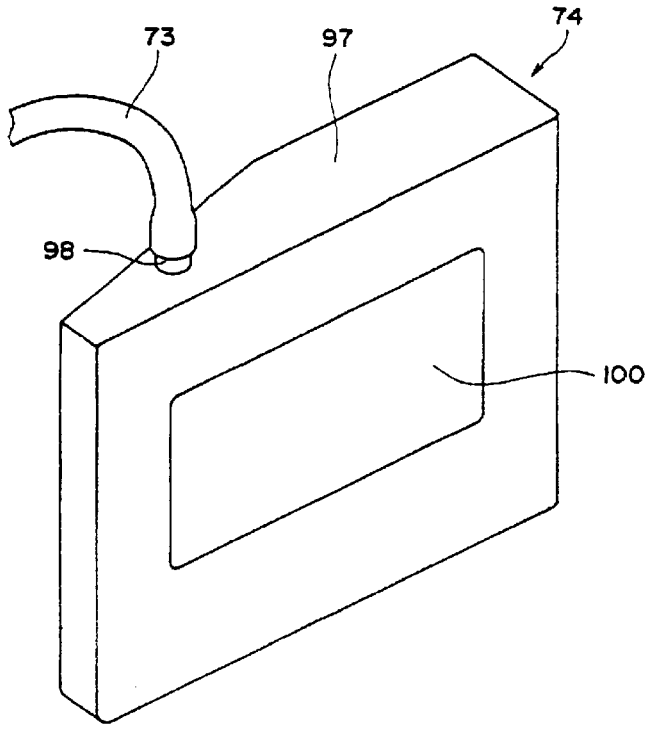
FIG. 8 is an isometric view showing toner storing means included in the illustrative embodiment.

As shown in FIG. 8, the toner storing means 74 is implemented as a tank 97 that is relatively wide and high, but not deep. The tank 97 is positioned in the sheet bank 43, FIG. 2, along and outside of the path 46. An inlet 98 is formed in one side of the top of the tank 97. The other end of the exhaust tube 73 is connected to the inlet 98. Filter-like toner collecting means 100 covers an opening formed in one side of the tank 97 at a slightly high level, as illustrated.

The toner collecting means 100 passes air therethrough while filtering out the toner. The toner collected by the toner collecting means 100 is stored in the tank 97. The toner collecting means 100 has a fine, continuous porous structure produced by orienting PTFE (polytetrafluoroethylene) by use of a special technique. Even when air under pressure is passed through the toner collecting means 100, oriented porous PTFE prevents the toner from leaking and surely collects it. In this sense, the toner collecting means 100 differs from conventional filters including an electrostatic filter.

In the above configuration, air sucked via the exhausting means 72 and exhaust tube 73 is introduced into the toner storing means 74. The toner collecting means 100 filters out the toner contained in the air stream. Air free from the toner is discharged to the outside of the copier body 10 via an exhaust grill not shown.

The toner storing means 74 includes toner sensing means, not shown, for determining whether or not the tank 97 is full. The tank 97 is replaced with a new tank when filled up with the collected toner.

Figure 9:
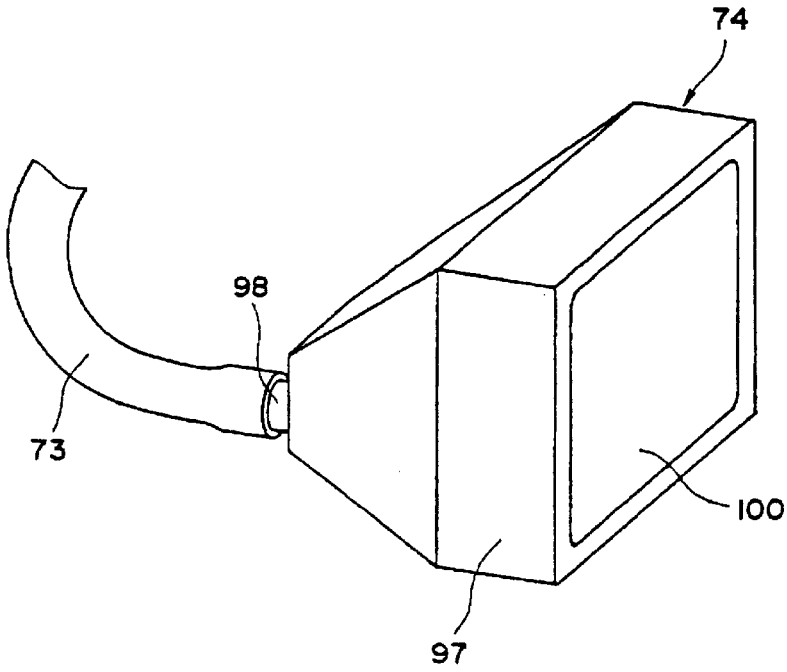
FIG. 9 is an isometric view showing another specific configuration of the toner storing means.

FIG. 9 shows another specific configuration of the toner storing means 74. In FIG. 9, structural elements identical with the structural elements shown in FIG. 8 are designated by identical reference numerals and will not be described specifically in order to avoid redundancy. It is to be noted that the window of the tank 97 and toner collecting means 100 covering it should preferably be as large as possible so as not to be stopped up.

The suction tube 71 and exhaust tube 73 that form an exhaust passage may, of course, be replaced with, e.g., pipes.

Figure 10:
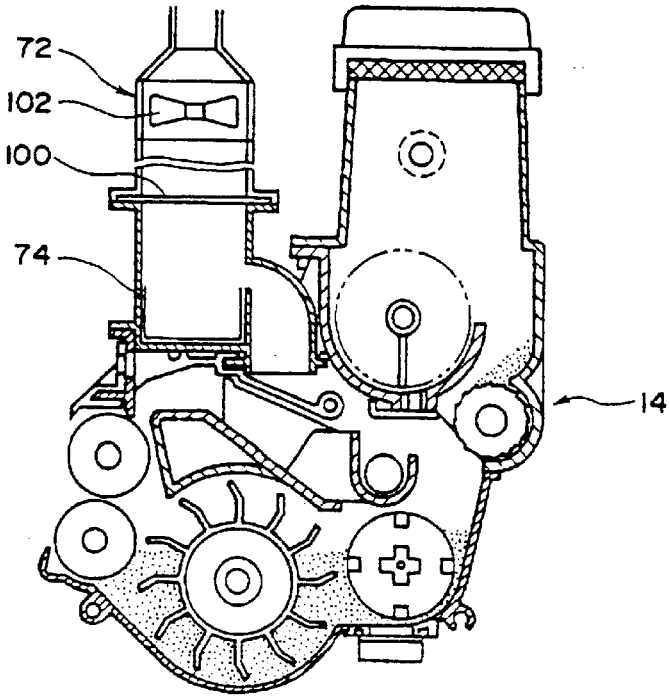
FIG. 10 is a view showing a modification of the illustrative embodiment.

FIG. 10 shows a modification of the illustrative embodiment. As shown, the toner storing means 74 and toner collecting means 100 are arranged upstream of the exhausting means 72 in the direction of air flow. The toner storing means 74 is implemented as a removable tray. The toner collected by the toner collecting means 100 does not drop into the toner present in the developing device 14, but drops on the toner storing means or tray 74. The toner storing means 74 with toner accumulated thereon is removed to discard the toner. This allows the collected toner to be easily dealt with.

In the above modification, the toner collected by the toner collecting means 100 accumulates on the toner storing means 74 and does not reach the exhausting means 72 located downstream of the toner storing means 74. This successfully removes the limitation on the kind of the exhausting means 72. For example, the exhausting means 72 may even be implemented as a fan 102. That is, optimal exhausting means 72 can be selected in consideration of cost, easy assembly and so forth.

Figure 11:
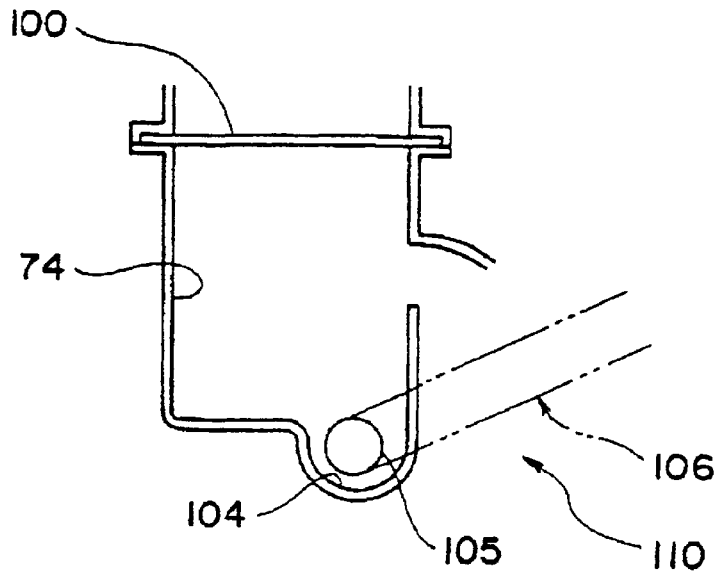
FIG. 11 is a view showing another modification of the illustrative embodiment.

FIG. 11 shows another modification of the illustrative embodiment. As shown, the modification includes toner recycling means 110. The toner recycling means 110 includes a recess 104 formed in the toner storing means 74 for storing the collected toner. A screw or similar conveying member 105 is positioned in the recess 104 for conveying the toner to one end of the recess 104. A screw, belt, coil or similar toner collecting member 106 returns the toner conveyed to one end of the recess 104 to, e.g., the developing device 14. The toner recycling means 110 allows the toner collected by the toner collecting means 110 to be reused and thereby reduces maintenance cost.

The two-ingredient type developer applied to the illustrative embodiment will be described specifically hereinafter.

The developer stored in the developing device 14 is made up of toner grains having a weight mean grain size of 5 μm to 10 μm and carrier grains having a weight mean grain size of 65 μm or below. 60% to 80% of the toner grains have a grain size of 5 μm or below for a unit number of grains.

The toner grains consist of a resin component and a colorant with or without a wax component and inorganic fine particles added thereto. The toner grains may be produced by either one of pulverization and polymerization. The resin component may be implemented by any one of conventional resins, e.g., a group of styrene resins including styrene, styrene-chlorostyrene copolymer, styrene-propylene copolymer, styrene-butadiene copolymer, styrene-vinyl chloride coploymer, styrene-vinyl acetate copolymer, styrene-maleic acid copolymer, styrene-acrylic ester copolymer, styrene-methacrylate ester copolymer, styrene-α-chloracrylate methyl copolymer and styrene-acrylonitrile-acrylic ester copolymer, monomers and polymers containing styrene or subsitutes thereof, polyester resins, epoxy resins, vinyl chloride resins, rosin-modified maleic acid resins, phenol resins, polyethylene resins, polyester resins, polypropylene resins, oil resins, polyurethane resins, ketone resins, ethyrene-ethyacrylate copolymer, xylene resins, and polyvinyl butylate resins. Such resins may be used alone or in combination.

As for the colorant, use may be made any conventional colorant, e.g., carbon black, lamp black, iron black, ultramarine blue, Nigrosine dye, Aniline Blue, Oil Black or Azo Oil Black.

The wax component may be any one of conventional waxes including carnauba wax, rice wax, and synthetic ester wax. The inorganic fine particles may be silica powder or titanium oxide powder by way of example.

As for the amount of toner to be collected, the combination of the above toner grains and carrier grains having a small grain size reduces the amount, compared to the combination of toner grains and carrier grains having the conventional grain size. This not only decelerates the stop-up of the toner collecting means 10, but also extends the time when the toner storing means 64 is to be filled up with the toner. More specifically, the combination of the toner grains and carrier grains both having a small grain size provides the individual carrier grain with a greater surface area than the conventional carrier grain for a given weight, thereby increasing the carrier coating ratio of the toner. Consequently, the probability that the toner contacts the carrier increases and obviates the defective charging of the toner. This allows much toner to deposit on the carrier for thereby reducing the amount of toner to fly about.

Figure 12:
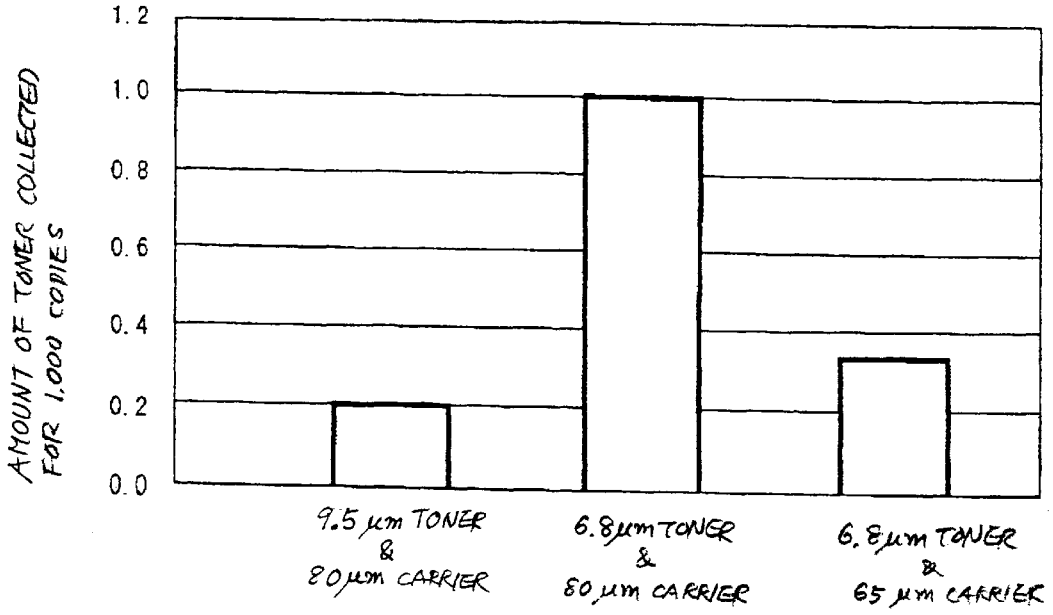
FIG. 12 is a graph showing experimental results indicative of a relation between the grain size of toner and that of carrier and the amount of toner collected.

FIG. 12 shows experimental results showing a relation between the toner grain size and carrier grain size and the amount of toner collected. As shown, carrier grains with a small grain size enhanced image quality and reduced the amount of toner collected at the same time when used in combination with toner with a small grain size.

In summary, it will be seen that the present invention provides an image forming apparatus with a toner scatter preventing device having various unprecedented advantages, as enumerated below.

(1) Toner collected by toner collecting means is stored in toner storing means. The device therefore prevents toner from scattering over a long period of time without being stopped up. In addition, the toner collected by the toner collecting means does not drop into toner present in a developing device or degrade image quality.

(2) The toner storing means can be freely arranged without regard to the arrangement of exhausting means, which is positioned upstream of the toner storing means. The toner storing means can therefore be easily mounted and dismounted.

(3) The toner collected by the toner collecting means is stored in the toner storing means, which is positioned upstream of the exhausting means. The toner therefore does not reach the exhausting means. This allows optimal exhausting means to be used in consideration of cost, easy assembly and so forth.

(4) The toner storing means is removable and allows the collected toner to be easily dealt with.

(5) Oriented, porous PTFE implementing the toner collecting means obviates the leakage of the toner even when air under pressure is passed through the toner collecting means, insuring the collection of the toner.

(6) Suction ports leading to an exhaust passage are positioned at both sides of a range over which fresh toner is to be replenished to the developing device. It follows that fresh toner just replenished to the developing device is prevented from being immediately sucked via the suction ports and discharged via the exhaust passage.

(7) Toner recycling means returns the toner stored in the toner storing means to the developing device and thereby reduces maintenance cost.

(8) Use is made of carrier grains having a weight mean grain size of 65 μm or below and therefore having a greater surface area than conventional carrier grains for a given weight, so that the carrier coating ratio of the toner increases. Consequently, the probability that the toner contacts the carrier increases and obviates the defective charging of the toner. This allows much toner to deposit on the carrier for thereby reducing the amount of toner to fly about. This not only decelerates the stop-up of the toner collecting means, but also extends the time when the toner storing means is to be filled up with the toner, thereby extending maintenance interval.

(9) The toner grains with a small grain size, coupled the linear velocity of an image carrier that is 400 mm/sec or above, reduces the amount of flying toner despite that it tends to increase due to such a high-speed operation. This further reduces the amount of toner to be collected.

Various modifications will become possible for those skilled in the art after receiving the teachings of the present disclosure without departing from the scope thereof.

What is claimed is:

1. A toner scatter preventing device for an image forming apparatus that develops a latent image formed on an image carrier with toner stored in a developing device, said toner scatter preventing device comprising:

exhausting means for discharging air present in the developing device via an exhaust passage, said exhausting means including a pump;

toner collecting means for collecting the toner entrained by air discharged by said exhausting means; and toner storing means positioned upstream of said toner collecting means in a direction of air flow for storing the toner collected by said toner collecting means without causing said toner to drop into the toner present in said developing device.

2. The device as claimed in claim 1, further comprising suction ports positioned at both sides of a range over which fresh toner is replenished to the developing device.

3. The device as claimed in claim 1, wherein said toner storing means is positioned upstream of said exhausting means.

4. The device as claimed in claim 3, wherein said toner storing means is removable.

5. The device as claimed in claim 4, wherein said toner colleting means is formed of oriented, porous PTFE (polyethylene terephthalate).

6. The device as claimed in claim 5, further comprising suction ports positioned at both sides of a range over which fresh toner is replenished to the developing device.

7. The device as claimed in claim 1, wherein said toner storing means is removable.

8. The device as claimed in claim 7, wherein said toner collecting means is formed of oriented, porous PTFE (polyethylene terephthalate).

9. The device as claimed in claim 8, further comprising suction ports positioned at both sides of a range over which fresh toner is replenished to the developing device.

10. The device as claimed in claim 1, wherein said toner collecting means is formed of oriented, porous PTFE (polyethylene terephthalate).

11. The device as claimed in claim 10, further comprising suction ports positioned at both sides of a range over which fresh toner is replenished to the developing device.

12. A toner scatter preventing device for an image forming apparatus that develops a latent image formed on an image carrier with toner stored in a developing device, said toner scatter preventing device comprising:

exhausting means for discharging air present in the developing device via an exhaust passage;

toner collecting means for collecting the toner entrained by air discharged by said exhausting means;

toner storing means positioned upstream of said toner collecting means in a direction of air flow for storing the toner collected by said toner collecting means without causing said toner to drop into the toner present in said developing device; and suction ports positioned at both sides of a range over which fresh toner is replenished to the developing device, wherein said toner storing means is positioned downstream of said exhausting means in the direction of air flow.

13. The device as claimed in claim 12, wherein said toner storing means is removable.

14. The device as claimed in claim 13, wherein said toner collecting means is formed of oriented, porous PTFE (polyethylene terephthalate).

15. In an image forming apparatus including a device for preventing toner present in a developing device from scattering, said device comprising:

exhausting means for discharging air present in the developing device via an exhaust passage, said exhausting means including a pump;

toner collecting means for collecting the toner entrained by air discharged by said exhausting means; and toner storing means positioned upstream of said toner collecting means in a direction of air flow for storing the toner collected by said toner collecting means without causing said toner to drop into the toner present in said developing device.

16. In an image forming apparatus including a device for preventing toner present in a developing device from scattering, said device comprising:

exhausting means for discharging air present in the developing device via an exhaust passage;

toner collecting means for collecting the toner entrained by air discharged by said exhausting means; and toner storing means positioned upstream of said toner collecting means in a direction of air flow for storing the toner collected by said toner collecting means without causing said toner to drop into the toner present in said developing device, wherein said device further comprises toner recycling means for returning the toner stored in said toner storing means to the developing device for reuse.

17. A toner scatter preventing device for an image forming apparatus that develops a latent image formed on an image carrier with a developer including toner stored in a developing device, said toner scatter preventing device comprising:

exhausting means for discharging air present in the developing device via an exhaust passage, said exhausting means including a pump;

toner collecting means for collecting the toner entrained by air discharged by said exhausting means; and toner storing means positioned upstream of said toner collecting means in a direction of air flow for storing the toner collected by said toner collecting means without causing said toner to drop into the toner present in said developing device;

wherein the developer comprises a toner and carrier mixture in which carrier grains have a weight mean grain size of 65 $\mu$m or below.

18. The device as claimed in claim 17, wherein the developing device is formed with suction ports at both sides of a range over which fresh toner is replenished to said developing device, said suction ports leading to said exhaust passage.

19. The device as claimed in claim 17, wherein an image carrier to which the developer is fed moves at a linear velocity of 400 mm/sec or above.

20. The device as claimed in claim 19, wherein said toner storing means is positioned either one of upstream and downstream of said exhausting means.

21. The device as claimed in claim 20, wherein said toner storing means is removable.

22. The device as claimed in claim 21, wherein said toner collecting means is formed of oriented, porous PTFE (polyethylene terephthalate).

23. The device as claimed in claim 22, wherein the developing device is formed with suction ports at both sides of a range over which fresh toner is replenished to said developing device, said suction ports leading to said exhaust passage.

24. The device as claimed in claim 17, wherein said toner storing means is positioned either one of upstream and downstream of said exhausting means.

25. The device as claimed in claim 24, wherein said toner storing means is removable.

26. The device as claimed in claim 25, wherein said toner collecting means is formed or oriented, porous PTFE (polyethylene terephthalate).

27. The device as claimed in claim 26, wherein the developing device is formed with suction ports at both sides of a range over which fresh toner is replenished to said developing device, said suction ports leading to said exhaust passage.

28. The device as claimed in claim 17, wherein said toner storing means is removable.

29. The device as claimed in claim 28, wherein said toner collecting means is formed of oriented porous PTFE (polyethylene terephthalate).

30. The device as claimed in claim 29, wherein the developing device is formed with suction ports at both sides of a range over which fresh toner is replenished to said developing device, said suction ports leading to said exhaust passage.

31. The device as claimed in claim 17, where said toner collecting means is formed of oriented, porous PTFE (polyethylene terephthalate).

32. The device as claimed in claim 31, wherein the developing device is formed with suction ports at both sides of a range over which fresh toner is replenished to said developing device, said suction ports leading to said exhaust passage.

33. A toner scatter preventing device for an image forming apparatus that develops a latent image formed on an image carrier with a developer including toner stored in a developing device, said toner scatter preventing device comprising:

exhausting means for discharging air present in the developing device via an exhaust passage;

toner collecting means for collecting the toner entrained by air discharged by said exhausting means; and toner storing means positioned upstream of said toner collecting means in a direction of air flow for storing the toner collected by said toner collecting means without causing said toner to drop into the toner present in said developing device;

wherein the developer comprises a toner and carrier mixture in which carrier grains have a weight mean grain size of 65 $\mu$m or below, and wherein the developer contains toner grains having a weight mean grain size of 5 $\mu$m to 10 $\mu$m and carrier grains having a weight mean grain size of 65 $\mu$m or below, and 60% to 80% of said toner grains have a weight mean grain size of 5 $\mu$m or below for a unit number of grains.

34. The device as claimed in claim 33, wherein an image carrier to which the developer is fed moves at a linear velocity of 400 mm/sec or above.

35. The device as claimed in claim 34, wherein said toner storing means is positioned either one of upstream and downstream of said exhausting means.

36. The device as claimed in claim 35, wherein said toner storing means is removable.

37. The device as claimed in claim 36, wherein said toner collecting means if formed of oriented, porous PTFE (polyethylene terephthalate).

38. The device as claimed in claim 37, wherein the developing device is formed with suction ports at both sides of a range over which fresh toner is replenished to said developing device, said suction ports leading to said exhaust passage.

39. In an image forming apparatus using a developer having toner and including a device for preventing the toner present in a developing device from scattering, said device comprising:

exhausting means for discharging air present in the developing device via an exhaust passage, said exhausting means including a pump;

toner collecting means for collecting the toner entrained by air discharged by said exhausting means; and toner storing means positioned upstream of said toner collecting means in a direction of air flow for storing the toner collected by said toner collecting means without causing said toner to drop into the toner present in said developing device;

wherein the developer comprises a toner and carrier mixture in which carrier grains have a weight mean grain size of 65 $\mu$m or below.

40. In an image forming apparatus using a developer having toner and including a device for preventing the toner present in a developing device from scattering, said device comprising:

exhausting means for discharging air present in the developing device via an exhaust passage;

toner collecting means for collecting the toner entrained by air discharged by said exhausting means; and toner storing means positioned upstream of said toner collecting means in a direction of air flow for storing the toner collected by said toner collecting means without causing said toner to drop into the toner present in said developing device;

wherein the developer comprises a toner and carrier mixture in which carrier grains have a weight mean grain size of 65 $\mu$m or below, and wherein said device further comprises toner recycling means for returning the toner stored in said toner storing means to the developing device for reuse.

41. A toner scatter preventing device for an image forming apparatus that develops a latent image formed on an image carrier with toner stored in a developing device, said toner scatter preventing device comprising:

an exhausting device for discharging air present in the developing device via an exhaust passage, said exhausting device including a pump;

a toner collecting device for collecting the toner entrained by air discharged by said exhausting device; and a toner storing device positioned upstream of said toner collecting device in a direction of air flow for storing the toner collected by said toner collecting device without causing said toner to drop into the toner present in said developing device.

42. A toner scatter preventing device for an image forming apparatus that develops a latent image formed on an image carrier with a developer including toner stored in a developing device, said toner scatter preventing device comprising:

an exhausting device for discharging air present in the developing device via an exhaust passage, said exhausting device including a pump;

a toner collecting device for collecting the toner entrained by air discharged by said exhausting device; and a toner storing device positioned upstream of said toner collecting device in a direction of air flow for storing the toner collected by said toner collecting device without causing the toner to drop into the toner present in said developing device;

wherein the developer comprises a toner and carrier mixture in which carrier grains have a weight mean grain size of 65 $\mu$m or below.

* * * * *